US007364405B2

(12) United States Patent
Cunha et al.

(10) Patent No.: US 7,364,405 B2
(45) Date of Patent: Apr. 29, 2008

(54) MICROCIRCUIT COOLING FOR VANES

(75) Inventors: Frank Cunha, Avon, CT (US); Matthew T. Dahmer, Auburn, MA (US)

(73) Assignee: United Technologies Corporation, Hartford, CT (US)

( * ) Notice: Subject to any disclaimer, the term of this patent is extended or adjusted under 35 U.S.C. 154(b) by 246 days.

(21) Appl. No.: 11/286,794

(22) Filed: Nov. 23, 2005

(65) Prior Publication Data

US 2007/0116569 A1 May 24, 2007

(51) Int. Cl.
*F01D 5/08* (2006.01)

(52) U.S. Cl. ..... 416/97 R; 29/889.721

(58) Field of Classification Search ..... 29/889.721
See application file for complete search history.

(56) References Cited

U.S. PATENT DOCUMENTS

2005/0031452 A1* 2/2005 Liang ..... 416/97 R
2007/0104576 A1* 5/2007 Cunha et al. ..... 416/97 R

FOREIGN PATENT DOCUMENTS

JP 2001-107704 4/2001

* cited by examiner

*Primary Examiner*—Richard A. Edgar
(74) *Attorney, Agent, or Firm*—Bachman & LaPointe, P.C.

(57) ABSTRACT

A turbine engine component has an airfoil portion with a suction side. The component includes a cooling microcircuit embedded within a wall structure forming the suction side. The cooling microcircuit has at least one cooling film hole positioned ahead of a gage point for creating a flow of cooling fluid over an exterior surface of the suction side which travels past the gage point. The cooling microcircuit is formed using refractory metal core technology. A method for forming the cooling microcircuit is described.

36 Claims, 3 Drawing Sheets

MICROCIRCUIT COOLING FOR VANES

BACKGROUND OF THE INVENTION (1) Field of the Invention

The present invention relates to a cooling microcircuit that addresses high thermal loads on the airfoil suction side in turbine engine components, such as turbine vanes.

(2) Prior Art

Turbine engine components such, as turbine vanes, are operated in high temperature environments. To avoid structural defects in the components resulting from their exposure to high temperatures, it is necessary to provide cooling circuits within the components. Turbine vanes in particular are subjected to high thermal loads on the suction side of the airfoil portion.

In addition to thermal load problems, cooling film exit holes on such components are frequently plugged by contaminants. Such plugging can cause a severe reduction in cooling effectiveness since the flow of cooling fluid over the exterior surface of the suction side is reduced.

SUMMARY OF THE INVENTION

In accordance with the present invention, a cooling microcircuit is provided which addresses high thermal loads on the suction side of the airfoil portion of turbine engine components, particularly turbine vanes, and which keeps the last row of cooling holes ahead of the gage or throat point which increases the performance of the cooling microcircuit.

In accordance with the present invention, a cooling microcircuit is provided which prevents slot exit plugging.

In accordance with the present invention, a turbine engine component having an airfoil portion with a suction side is provided. The turbine engine component broadly comprises a cooling microcircuit embedded within a wall structure forming the suction side. The cooling microcircuit has at least one cooling film hole positioned ahead of a gage point for creating a flow of cooling fluid over an exterior surface of the suction side which travels past the gage point.

In accordance with the present invention, a refractory metal sheet for use in creating a cooling microcircuit within a wall of an airfoil portion of a turbine engine component. The refractory metal sheet has a first end wall, a second end wall, and two sidewalls connecting the end walls, at least one first curved tab bent in a first direction and spaced from the side walls and the end walls, and at least one second tab bent in a second direction and spaced from the side walls and the end walls.

In accordance with the present invention, a method for forming a turbine engine component having an airfoil portion broadly comprises the steps of providing a die in the shape of the turbine engine component, inserting a refractory metal sheet having a first end wall, a second end wall, and two sidewalls connecting the end walls, at least one first curved tab bent in a first direction and spaced from the side walls and the end walls, and at least one second tab bent in a second direction and spaced from the side walls and the end walls into the die, inserting at least one core in the die to form at least one central core element, flowing molten metal into the die and allowing the molten metal to solidify so as to form the turbine engine component and so as to form a cooling microcircuit in a wall of the turbine engine component, which cooling microcircuit has at least one cooling fluid inlet and at least one cooling fluid exit hole, and removing the refractory metal sheet and the at least one core.

Other details of the microcircuit cooling for vanes of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

The present invention relates to an internal cooling microcircuit positioned within the airfoil portion of a turbine engine component such as a turbine vane.

Figure 1:
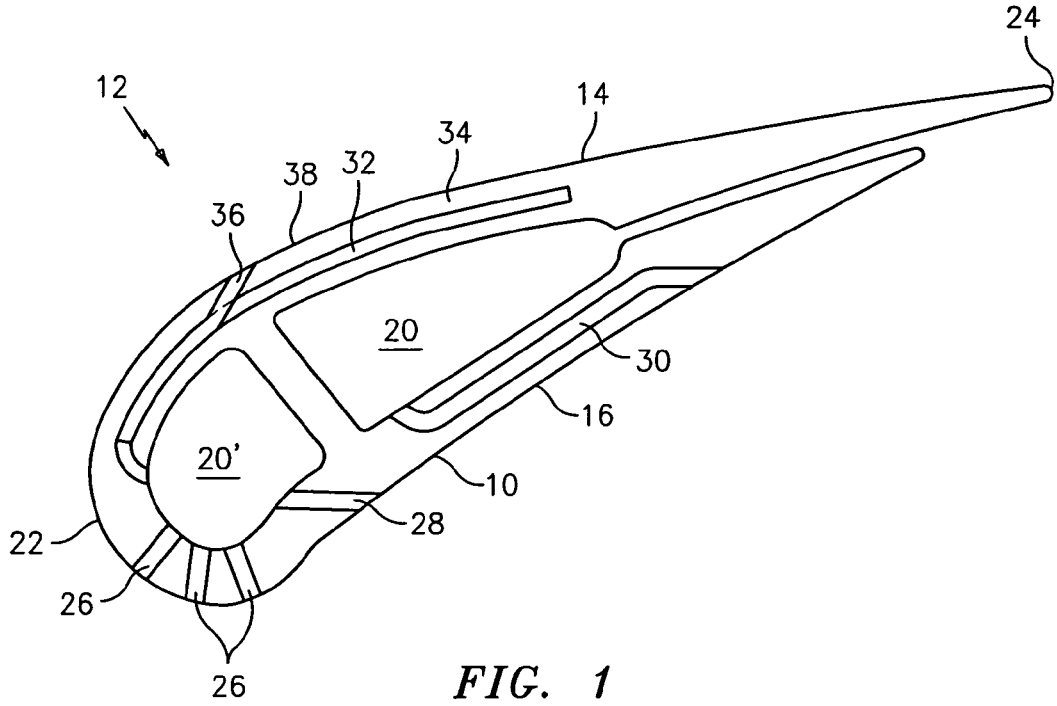
FIG. 1 illustrates an airfoil portion of a turbine engine component having a cooling microcircuit embedded within a wall on a suction side of the airfoil portion.

FIG. 1 illustrates an airfoil portion 10 of a turbine engine component 12 such as a turbine vane. The airfoil portion 10 has a suction side 14 and a pressure side 16. The airfoil portion 10 also may have one or more core elements 20 and 20' through which cooling fluid may flow. Each core element 20 and 20' may communicate with a source (not shown) of a cooling fluid such as engine bleed air. The airfoil portion 10 has a leading edge 22 and a trailing edge 24.

The airfoil portion 10 may have a number of passageways for cooling various portions of its exterior surface. For example, the airfoil portion 10 may have one or more leading edge cooling passageways 26 and 28 which are in fluid communication with the core element 20'. The airfoil portion 10 may also have a cooling passageway 30 for causing cooling fluid to flow over a portion of the pressure side 16.

A cooling microcircuit 32 is provided within the metal wall 34 forming the suction side 14 to convectively cool the turbine engine component 10. The cooling microcircuit 34 has one or more cooling fluid exit holes 36 for causing a cooling fluid film to flow over the exterior surface of the suction side 14. As shown in FIG. 1, each fluid exit hole 36 is ahead of the gage or throat point 38. The cooling microcircuit 32 however extends beyond the gage or throat point 38.

Figure 2:
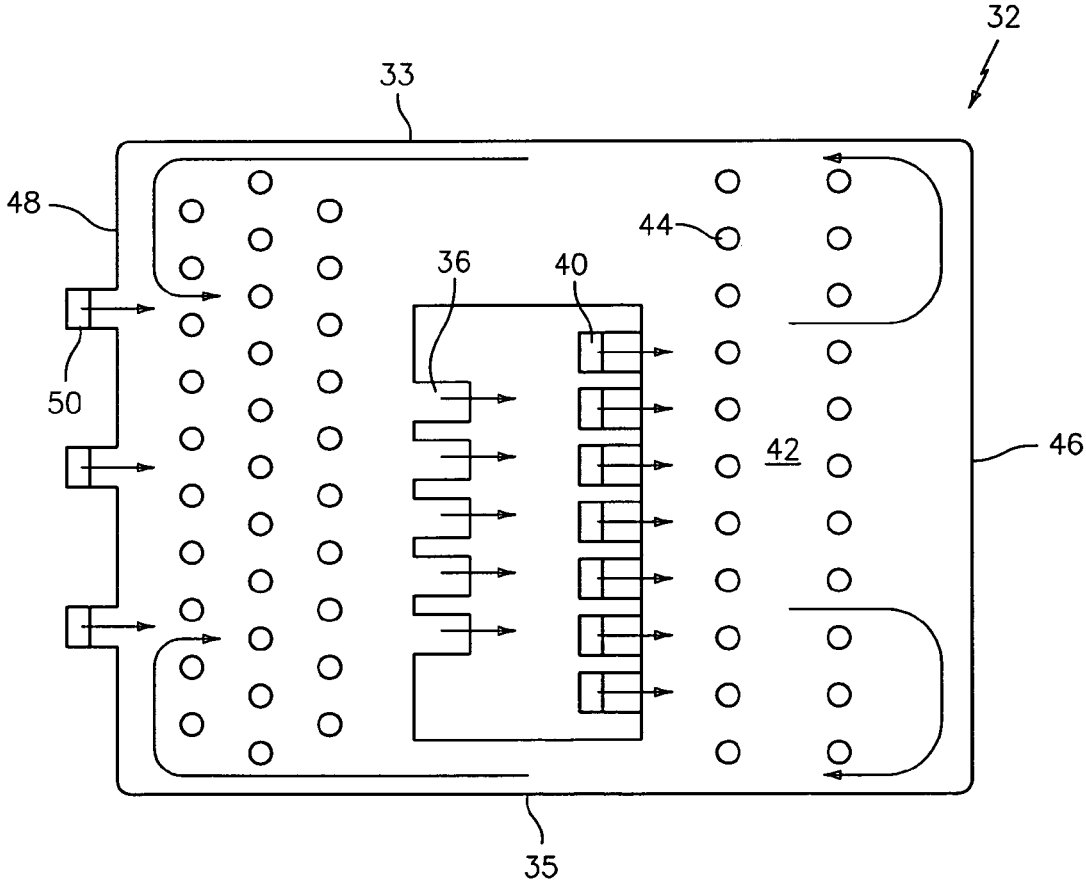
FIG. 2 is a schematic representation of a first embodiment of a cooling microcircuit.

Referring now to FIG. 2, there is shown the flow pattern of a first embodiment of the cooling microcircuit 32. As can be seen from this figure, the cooling microcircuit has one or more fluid inlets 40 which communicate with the cooling fluid flowing through the core element 20. Each of the fluid inlets 40 is curved so as to accelerate the cooling fluid as it enters the cooling microcircuit 32. The cooling microcircuit 32 has a relatively long, transversely extending passageway 42 to maintain the relatively high velocity of the cooling fluid flow for as long as possible. Preferably, the passageway 42 extends a distance which is from 10 to 40% of the chord of the airfoil portion.

Along the length of the passageway 42, a number of internal features 44, such as rounded pedestals, may be provided to increase the cooling efficiency of the microcircuit 32 and to provide strength to the microcircuit 32. The cooling fluid flow leaving the inlet(s) 40 flows first in a direction toward the trailing edge 24 of the airfoil portion 10. At a first end wall 46 of the cooling microcircuit 32, the cooling fluid flow is turned around and flows in a direction toward the leading edge 22 of the airfoil portion 10. As a result of the turn at the first end wall 46, the cooling fluid flow loses momentum.

When the cooling fluid flow reaches the second end wall 48 of the cooling microcircuit 32, it is again turned so as to flow through the one or more cooling film exit holes 36 onto the external surface of the suction side 14 of the airfoil portion 10. If there is a plurality of holes 36, the holes 36 may be arranged in one or more rows if desired.

The cooling microcircuit 32 has transverse boundary walls 33 and 35 that connect the end walls 46 and 48. The inlet(s) 40 and the exit hole(s) 36 are centrally located and spaced from the boundary walls 33 and 35.

One or more refresher re-supply holes 50 may be provided at the second end wall 48 so as to introduce fresh cooling fluid into the microcircuit 32 and to cause the cooling fluid flow to accelerate as the fluid flows through the exit hole(s) 36. With this increase in momentum, the cooling flow exiting through the hole(s) 36 is able to repel any contaminants from the external fluid flowing around the airfoil portion 10 and thereby avoid plugging of the exit hole(s) 36. Each of the refresher re-supply holes 50 may communicate with a source of cooling fluid (not shown) via the core element 20'.

The refreshed flow of cooling fluid then exits through the cooling film exit hole(s) 36 onto the exterior surface of the suction side 14. As can be seen from FIG. 1, the exit hole(s) 36 are positioned so that the last row of exit hole(s) 36 is ahead of the gage or throat point 38. In order to provide a more effective cooling flow over the exterior surface of the suction side 14 to improve film coverage, the exit hole(s) 36 are at a shallow angle a with respect to the exterior surface. Preferably, the angle $\alpha$ is in the range of from 15 to 30 degrees.

The fact that the flow bends at high velocity is particularly important for stationary components such as turbine vanes as it provides beneficial secondary flow effects for cooling. The cooling microcircuit 32 of the present invention has the last row of exit hole(s) 36 ahead of the gage or throat point 38 while it cools an area of the airfoil portion 10 after or beyond the gage or throat point 38, all without any impact on aerodynamic performance.

Figure 3:
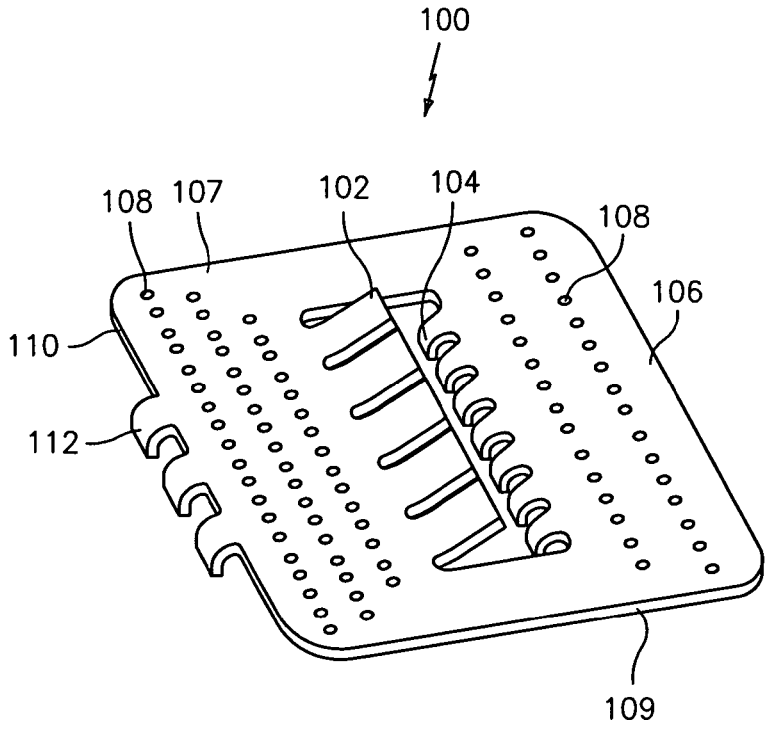
FIG. 3 illustrates a refractory metal sheet which may be used to form the cooling microcircuit of FIG. 2.

Referring now to FIG. 3, there is shown a refractory metal core sheet 100 that may be used to form the cooling microcircuit 32. The refractory metal core sheet 100 may be formed from any suitable refractory material known in the art. In a preferred embodiment, the refractory metal core sheet 100 is formed from a material selected from the group consisting of molybdenum or a molybdenum based alloy. As used herein, the term "molybdenum based alloy" refers to an alloy containing more than 50 wt % molybdenum.

The refractory metal core sheet 100 may be shaped to conform with the profile of the airfoil portion 10. The refractory metal core sheet 100 has a first end wall 106 and a second end wall 110. A pair of side walls 107 and 109 connect the two end walls 106 and 110. The refractory metal core sheet 100 is provided with one or more outwardly angled, bent tabs 102 extending in a first direction which eventually form the film cooling exit hole(s) 36 and one or more inwardly directed, bent tabs 104 which extend in a second direction and form the inlet(s) 40 for the cooling microcircuit 32. The tabs 102 and 104 are each centrally located and are spaced from the side walls 107 and 109 and the end walls 106 and 110. In a preferred embodiment, the tab(s) 102 is/are substantially linear in configuration and form a shallow angle $\alpha$ with the plane of the refractory metal sheet 100. Similarly, the tab(s) 104 is/are preferably curved so as to form a curved inlet 40.

The first end wall 106 forms the first end 46 of the cooling microcircuit 32. Intermediate the tabs 104 and the first end wall 106 are a plurality of holes 108 extending through the sheet 100. The holes 108 ultimately form the internal features 44 within the cooling microcircuit 32. The holes 108 may be arranged in one or more rows. The second end wall 110 forms the second end 48 of the cooling microcircuit 32. A plurality of additional holes 108 may be located between the second end wall 110 and the tabs 102. The additional holes 108 also form a plurality of internal features 44. The additional holes 108 may be arranged in one or more rows.

The end wall 110 of the refractory metal core sheet 100 may be provided with one or more curved bent tabs 112 which may be used to form the re-supply holes 50 for the fresh coolant supply which is used to accelerate the flow of fluid exiting through the cooling film exit hole(s) 36.

Figure 4:
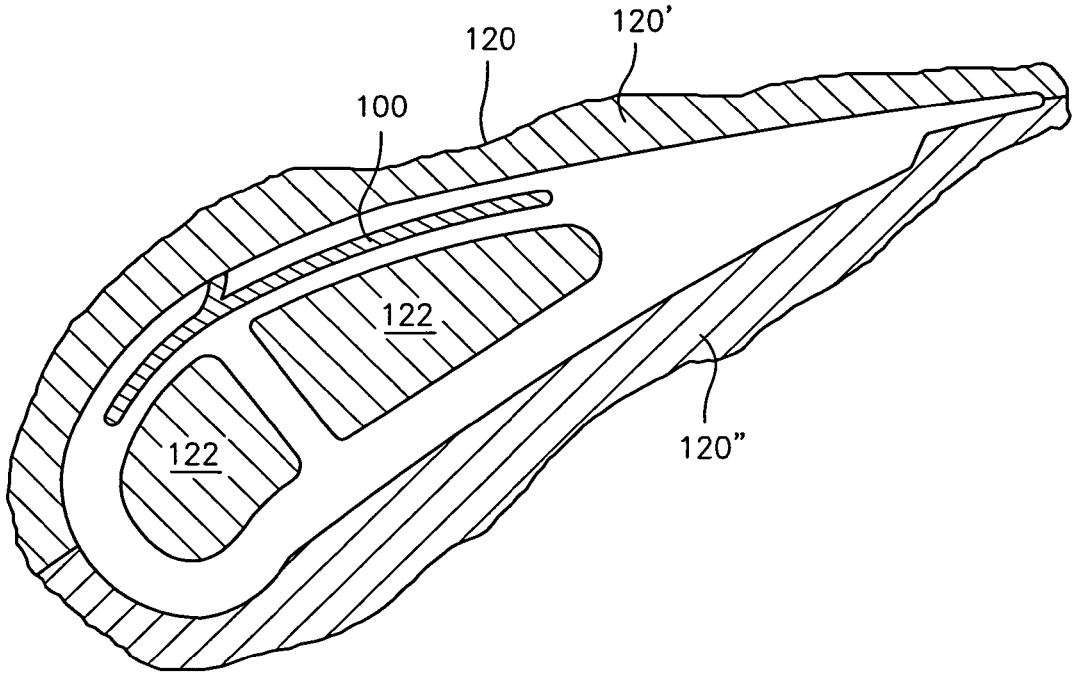
FIG. 4 is a schematic representation of a portion of a die for forming a cooling microcircuit in the turbine engine component.

Referring now to FIG. 4, to form the cooling microcircuit 32, the refractory metal core sheet 100 is placed within a die 120 preferably having two halves 120' and 120". The sheet 100 is placed within the die 120 so that the cooling film exit hole(s) 36 will be located in front of the gage or throat point 38 on the suction side 14 of the airfoil portion 10. Silica or aluminum cores 122 may be used to form the core elements 20 and 20'. The cores 122 are also positioned within the die 120. After the refractory metal core sheet 100 and the cores 122 have been placed in the die 120, molten metal is introduced into the die 120 in any suitable manner known in the art. The molten metal, upon cooling, solidifies and forms the walls of the airfoil portion 10. Thereafter the cores 122 and the refractory metal core sheet 100 are removed, typically chemically, using any suitable removal technique known in the art. Removal of the refractory metal core sheet 100 leaves the cooling microcircuit 32 within the wall 34 forming the suction side 14 of the airfoil portion 10.

Figure 5:
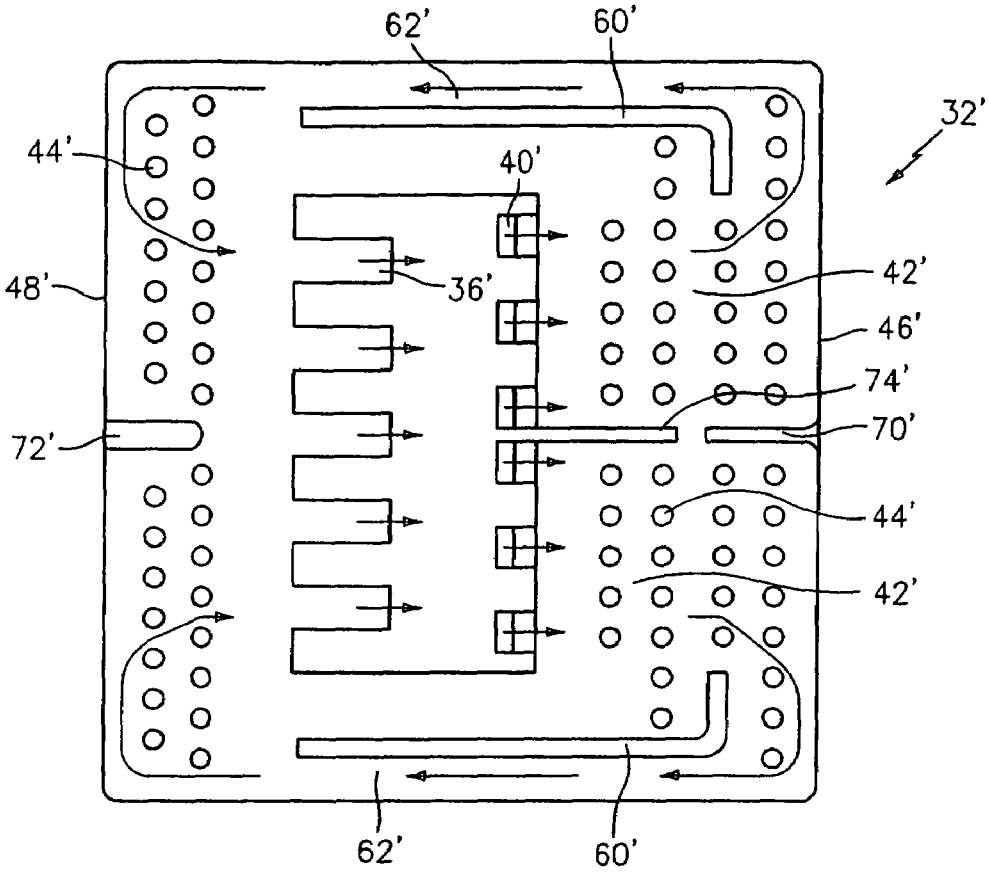
FIG. 5 is a schematic representation of a second embodiment of a cooling microcircuit.

Referring now to FIG. 5, there is shown an alternative embodiment of a cooling microcircuit 32' that can be used in the turbine engine component 12. The cooling microcircuit 32' may have one or more inlets 40' through which cooling fluid enters the microcircuit 32'. The flow is introduced into a transversely extending fluid passageway 42'. As can be seen from the figure, the fluid passageway has a plurality of internal features 44' such as rounded pedestals arranged in rows. The microcircuit 32' has a first end wall 46' which causes the flow of cooling fluid to turn from flow in a first direction to flow in a second direction opposed to the first direction. A plurality of substantially L-shaped bodies 60' may be provided in the cooling microcircuit 32' to form return passageways 62'. The cooling microcircuit 32' has a second end wall 48' which causes the cooling fluid flow to turn towards the exit hole(s) 36'. Additional internal features 44' may be provided between the second end 48' and the cooling fluid exit hole(s) 36'.

Figure 6:
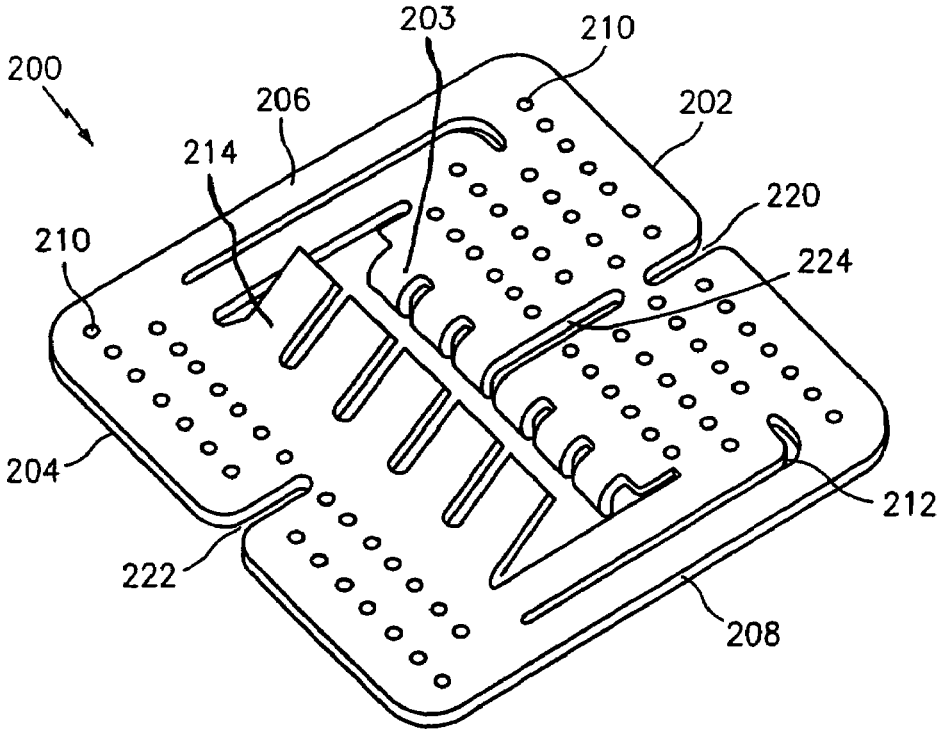
FIG. 6 illustrates a refractory metal sheet which may be used to form the cooling microcircuit of FIG. 5.

Referring now to FIG. 6, there is shown a refractory metal core sheet 200 which may be used to form the cooling microcircuit 32'. The refractory metal core sheet 200 has a first end 202, a second end 204, and side walls 206 and 208 connecting the first and second ends 202 and 204. One or more curved bent tabs 203 are provided which form the inlet passageways 40'. The tab(s) 203 is/are centrally located in the sheet and are spaced from the side walls 206 and 208. The tab(s) 203 extend inwardly in a first direction. A plurality of holes 210 are provided intermediate the tab(s) 203 and the first end 202. The holes 210 may be arranged in one or more rows and are used to form the internal features 44'. The refractory metal core sheet 200 has a pair of substantially L-shaped apertures 212 which are used to form the L-shaped bodies 60'.

The refractory metal core sheet 200 further has one or more substantially linear tabs 214 which form the exit hole(s) 36'. The linear tab(s) 214 is/are centrally located in the sheet and are spaced from the side walls 206 and 208. The tab(s) 214 extend outwardly in a second direction. A plurality of additional holes 210 may be provided between the second end 204 and the tab(s) 214. The additional holes 210 are used to form additional internal features 44'. The additional holes 210 may be arranged in one or more rows.

As can be seen from FIG. 6, the refractory metal core sheet 200 has a first notch 220 extending inwardly from the end wall 202 and a second notch 222 extending inwardly from the end wall 204. Still further, the refractory metal core sheet 200 may have an internal notch 224. The notches 220, 222, and 224 are used to form wall structures 70', 72'and 74'in the cooling microcircuit 32'.

As before, the refractory metal core sheet 200 may be formed from any suitable refractory metal known in the art. Preferably, it is formed from a material selected from the group consisting of molybdenum and a molybdenum based alloy.

The cooling microcircuits of the present invention improve cooling efficiency and film effectiveness that leads to increases in overall cooling effectiveness which are not feasible with existing, less advanced cooling schemes. The cooling microcircuits of the present invention cool the airfoil portion beyond the gage or throat point and prevent exit plugging at the same time.

The cooling microcircuit of the present invention may be used in turbine engine components other than turbine vanes. For example, it could be used in seals and blades.

It is apparent that there has been provided in accordance with the present invention a microcircuit cooling for vanes which fully satisfies the objects, means and advantages set forth hereinbefore. While the present invention has been described in the context of specific embodiments thereof, other unforeseeable alternatives, modifications and variations will become apparent to those skilled in the art having read the foregoing description. Accordingly, it is intended to embrace those alternatives, modifications, and variations as fall within the broad scope of the appended claims.

What is claimed is:

1. A turbine engine component having an airfoil portion with a suction side, said component comprising:

a cooling microcircuit embedded within a wall structure forming said suction side;

said cooling microcircuit having at least one cooling film hole positioned ahead of a gage point for creating a flow of cooling fluid over an exterior surface of said suction side which travels past said gage point;

said cooling microcircuit extending beyond said gage point to provide cooling along said suction side beyond said gage point; and at least one inlet for receiving cooling fluid from a source of said cooling fluid, each said inlet being curved so as to accelerate the cooling fluid as the cooling fluid enters the cooling microcircuit.

2. The turbine engine component according to claim 1, further comprising said microcircuit having a first transverse boundary wall and a second transverse boundary wall, and said at least one inlet being spaced from said first and second transverse boundary walls.

3. The turbine engine component according to claim 2, further comprising a plurality of fluid inlets being spaced from said first and second transverse boundary walls.

4. The turbine engine component according to claim 1, further comprising a plurality of cooling film exit holes for causing cooling fluid to flow over the exterior surface of said suction side.

5. The turbine engine component of claim 1, wherein said turbine engine component comprises a turbine vane.

6. A turbine engine component having an airfoil portion with a suction side, said component comprising:

a cooling microcircuit embedded within a wall structure forming said suction side;

said cooling microcircuit having at least one cooling film hole positioned ahead of a gage point for creating a flow of cooling fluid over an exterior surface of said suction side which travels past said gage point;

at least one inlet for receiving cooling fluid from a source of said cooling fluid, each said inlet being curved so as to accelerate the cooling fluid as the cooling fluid enters the cooling microcircuit; and a first transversely extending fluid passageway for directing fluid flow within said microcircuit in a direction towards a trailing edge of said airfoil portion.

7. The turbine engine component according to claim 6, wherein said first fluid passageway extends beyond said gage point to provide cooling along said suction side beyond said gage point.

8. The turbine engine component according to claim 7, further comprising a second end wall for turning the flow of said cooling fluid so as to cause said cooling fluid to flow through said at least one cooling film exit hole.

9. The turbine engine component according to claim 8, further comprising said second end wall having a plurality of means for refreshing the flow of said cooling fluid and thereby causing said cooling fluid flow to accelerate as the cooling fluid flows through said at least one cooling film exit hole.

10. The turbine engine component according to claim 9, wherein said refreshing means comprises at least one re-supply hole in said second end wall and said at least one re-supply hole communicating with a source of cooling fluid.

11. The turbine engine component according to claim 10, wherein said refreshing means comprises a plurality of re-supply holes communicating with said source of cooling fluid.

12. The turbine engine component according to claim 6, further comprising a plurality of internal features within said fluid passageway.

13. The turbine engine component according to claim 12, wherein each of said internal features comprises a rounded pedestal.

14. The turbine engine component according to claim 6, wherein said microcircuit further has a first end wall and at least one second fluid passageway for turning the flow of said cooling fluid and causing said cooling fluid to flow towards a leading edge of said airfoil portion.

15. The turbine engine component according to claim 14, wherein said microcircuit has a plurality of second fluid passageways.

16. A refractory metal sheet for use in creating a cooling microcircuit within a wall of an airfoil portion of a turbine engine component, said refractory metal sheet having a first end wall, a second end wall, and two sidewalls connecting said end walls, at least one first curved tab bent in a first direction and spaced from said side walls and said end walls, at least one second tab bent in a second direction and spaced from said side walls and said end walls, and at least one third tab attached to said second end of said refractory sheet.

17. The refractory metal sheet according to claim 16, further comprising a plurality of first tabs and a plurality of second tabs and each of said first and second tabs being spaced from said side walls and said end walls.

18. The refractory metal sheet according to claim 17, wherein each of said second tabs is substantially linear.

19. The refractory metal sheet according to claim 16, wherein each said third tab is curved.

20. The refractory metal sheet according to claim 16, further comprising a plurality of third tabs attached to said second end and each of said third tabs being spaced from said side walls.

21. The refractory metal sheet according to claim 16, further comprising at least one row of holes extending through said sheet and said at least one row of holes being positioned between said first end wall and said at least one first tab.

22. The refractory metal sheet according to claim 21, further comprising a plurality of rows of holes extending through said sheet between said first end wall and said at least one first tab.

23. The refractory metal sheet according to claim 16, further comprising at least one row of holes positioned between said second wall and said second tabs.

24. The refractory metal sheet according to claim 23, further comprising a plurality of rows of holes positioned between said second wall and said second tabs.

25. The refractory metal sheet according to claim 16, wherein said sheet is formed from a refractory material.

26. The refractory metal sheet according to claim 16, wherein said sheet is formed from a material selected from the group consisting of molybdenum and a molybdenum based alloy.

27. A refractory metal sheet for use in creating a cooling microcircuit within a wall of an airfoil portion of a turbine engine component, said refractory metal sheet having a first end wall, a second end wall, and two sidewalls connecting said end walls, at least one first curved tab bent in a first direction and spaced from said side walls and said end walls, and at least one second tab bent in a second direction and spaced from said side walls and said end walls, at least one row of holes extending through said sheet and said at least one row of holes being positioned between said first end wall and said at least one first tab, at least one L-shaped aperture extending through said sheet and each said L-shaped aperture extending from a first point substantially adjacent to said at least one second tab to a second point spaced from said first end wall.

28. The refractory metal sheet according to claim 27, further comprising a plurality of L-shaped apertures.

29. A refractory metal sheet for use in creating a cooling microcircuit within a wall of an airfoil portion of a turbine engine component, said refractory metal sheet having a first end wall, a second end wall, and two sidewalls connecting said end walls, at least one first curved tab bent in a first direction and spaced from said side walls and said end walls, at least one second tab bent in a second direction and spaced from said side walls and said end walls, and a notch cut into each of said end walls and another notch cut into a central portion of said refractory sheet.

30. A method for forming a turbine engine component having an airfoil portion comprising the steps of:

providing a die in the shape of said turbine engine component;

inserting a refractory metal sheet having a first end wall, a second end wall, and two sidewalls connecting said end walls, at least one first curved tab bent in a first direction and spaced from said side walls and said end walls, and at least one second tab bent in a second direction and spaced from said side walls and said end walls into said die;

said refractory metal sheet inserting step comprising inserting a refractory metal sheet having at least one third tab along said second end;

inserting at least one core in said die to form at least one central core element;

flowing molten metal into said die and allowing said molten metal to solidify so as to form said turbine engine component and so as to form a cooling microcircuit in a wall of said turbine engine component, which cooling microcircuit has at least one cooling fluid inlet and at least one cooling fluid exit hole; and removing said refractory metal sheet and said at least one core.

31. The method according to claim 30, wherein said removing step comprises chemically removing said refractory metal sheet.

32. The method according to claim 30, wherein said refractory metal sheet inserting step comprises positioning said refractory metal sheet so that said at least one cooling fluid exit hole is formed ahead of a gage point on a suction side of said airfoil portion.

33. The method according to claim 30, wherein said refractory metal sheet inserting step comprises inserting a refractory metal sheet having a plurality of holes so as to form internal features in said cooling microcircuit.

34. The method according to claim 30, wherein said refractory metal sheet inserting step comprises inserting a refractory metal sheet having a first notch cut into said first end and a second notch cut into said second end.

35. The method according to claim 30, wherein said core inserting step comprises inserting at least one core formed from a material selected from the group of silica and alumina.

36. A Method for forming a turbine engine component having an airfoil portion comprising the steps of:

providing a die in the shape of said turbine engine component;

inserting a refractory metal sheet having a first end wall, a second end wall, and two sidewalls connecting said end walls, at least one first curved tab bent in a first direction and spaced from said side walls and said end walls, and at least one second tab bent in a second direction and spaced from said side walls and said end walls into said die;

inserting at least one core in said die to form at least one central core element;

flowing molten metal into said die and allowing said molten metal to solidify so as to form said turbine engine component and so as to form a cooling microcircuit in a wall of said turbine engine component, which cooling microcircuit has at least one cooling fluid inlet and at least one cooling fluid exit hole;

removing said refractory metal sheet and said at least one core; and said refractory metal sheet inserting step comprising inserting a refractory metal sheet having at least one L-shaped aperture.

* * * * *

UNITED STATES PATENT AND TRADEMARK OFFICE

CERTIFICATE OF CORRECTION

PATENT NO. : 7,364,405 B2
APPLICATION NO. : 11/286794
DATED : April 29, 2008
INVENTOR(S) : Frank Cunha et al.

It is certified that error appears in the above-identified patent and that said Letters Patent is hereby corrected as shown below:

In column 8, claim 36, line 43, delete "A Method" and insert --A method--.

Signed and Sealed this

Sixteenth Day of September, 2008

JON W. DUDAS
*Director of the United States Patent and Trademark Office*